United States Patent [19]

Kreutel, Jr.

[11] Patent Number: 4,595,929

[45] Date of Patent: Jun. 17, 1986

[54] SCHEME FOR ABERRATION CORRECTION IN SCANNING OR MULTIPLE BEAM CONFOCAL ANTENNA SYSTEM

[75] Inventor: Randall W. Kreutel, Jr., Rockville, Md.

[73] Assignee: Communications Satellite Corporation, Washington, D.C.

[21] Appl. No.: 367,853

[22] Filed: Apr. 13, 1982

[51] Int. Cl.[4] ..... H01Q 19/19

[52] U.S. Cl. ..... 343/781 P; 343/373

[58] Field of Search ..... 343/781 P, 368, 370, 343/373, 909, 781 CA, 781 R

[56] References Cited

U.S. PATENT DOCUMENTS 4,259,674 3/1981 Dragone et al. ..... 343/909

4,388,626 6/1983 Gans ..... 343/373

*Primary Examiner*—Eli Lieberman

*Assistant Examiner*—K. Ohralik

*Attorney, Agent, or Firm*—Sughrue, Mion, Zinn, Macpeak, and Seas

[57] ABSTRACT

A frequency conversion interface is disposed between the main and subreflectors in a multiple beam antenna system so that the antenna system amplification factor will be defined by $m=(f_1/f_2)\cdot(\omega_1/\omega_2)$, to permit large main reflector to subreflector area ratios while maintaining small amplification factors.

4 Claims, 3 Drawing Figures

CONFOCAL PARABOLOIDS
CREGORIAN OFFSET FORM

DETAIL OF RF INTERFACE

SCHEME FOR ABERRATION CORRECTION IN SCANNING OR MULTIPLE BEAM CONFOCAL ANTENNA SYSTEM

BACKGROUND OF THE INVENTION

The present invention is directed to aberration correction in a scanning (or multiple beam) confocal antenna system.

Confocal antenna systems having main and subreflectors are well known and widely used. Two common types of multiple reflector antenna systems are the Cassegrain reflector system and Gregorian reflector system. FIG. 1 illustrates an offset (or eccentric) confocal paraboloidal antenna system of the Gregorian type. The magnification of the system shown in FIG. 1 is defined as $m=f_1/f_2$, where $f_1$ is the focal length of the main reflector 10 and $f_2$ is the focal length of the subreflector 12. With such a magnification, in order to form a beam having a propagation direction 14 forming an angle $\theta_0$ with respect to the system axis 16, the wave front generated from the plane wave feed 18 via the array of radiating elements 20 must be tilted at an angle of approximately $m \cdot \theta_0$.

The reflector system shown in FIG. 1 has several characteristics which are desirable in a scanning or multiple beam antenna. The system is fully corrected for all orders of spherical aberrations, for third and fifth order coma aberrations, and for third order astigmatism. Further, when the plane wave feed system consists of a phased array, the physical size of the array can be reduced by a factor of m relative to the radiating aperture of the system.

Generally, the antenna designer would like to make m large in order to reduce the size of the feed system. However, this involves a necessary trade-off against field of view requirements, i.e. the required scanning range of the feed, and curvature of field, distortion and higher orders of coma and astigmatism aberrations which are not corrected in the system and are dependent on m. The result is frequently a system in which the physical size of the subreflector approaches that of the main reflector, which is undesirable and impractical for most applications.

SUMMARY OF THE INVENTION

It is an object of this invention to provide a confocal multiple beam antenna which is not subject to the design constraints discussed above.

Briefly, this is achieved according to the present invention by a multiple beam confocal antenna comprising a feed and subreflector system operating at a certain frequency $\omega_1$, which is joined to the main reflector system via a frequency conversion interface which radiates at a frequency $\omega_2$. With the feed and subreflector system operating at a different frequency than the main system, the overall magnification of the antenna system is given by $m=(\omega_1/\omega_2)\cdot(f_1/f_2)$. By inserting the frequency conversion interface between the main and subreflectors, the antenna parameters can be more easily controlled while at the same time the physical size of the feed system can be maintained relatively small. This can be accomplished while allowing the system to be fully corrected for all orders of spherical aberrations, for third and fifth order coma and for third order astigmatism while preserving the signal phase through the frequency conversion.

BRIEF DESCRIPTION OF THE DRAWINGS

The invention will be more clearly understood from the following description in conjunction with the accompanying drawings, in which.

DETAILED DESCRIPTION OF THE INVENTION

Figure 2:
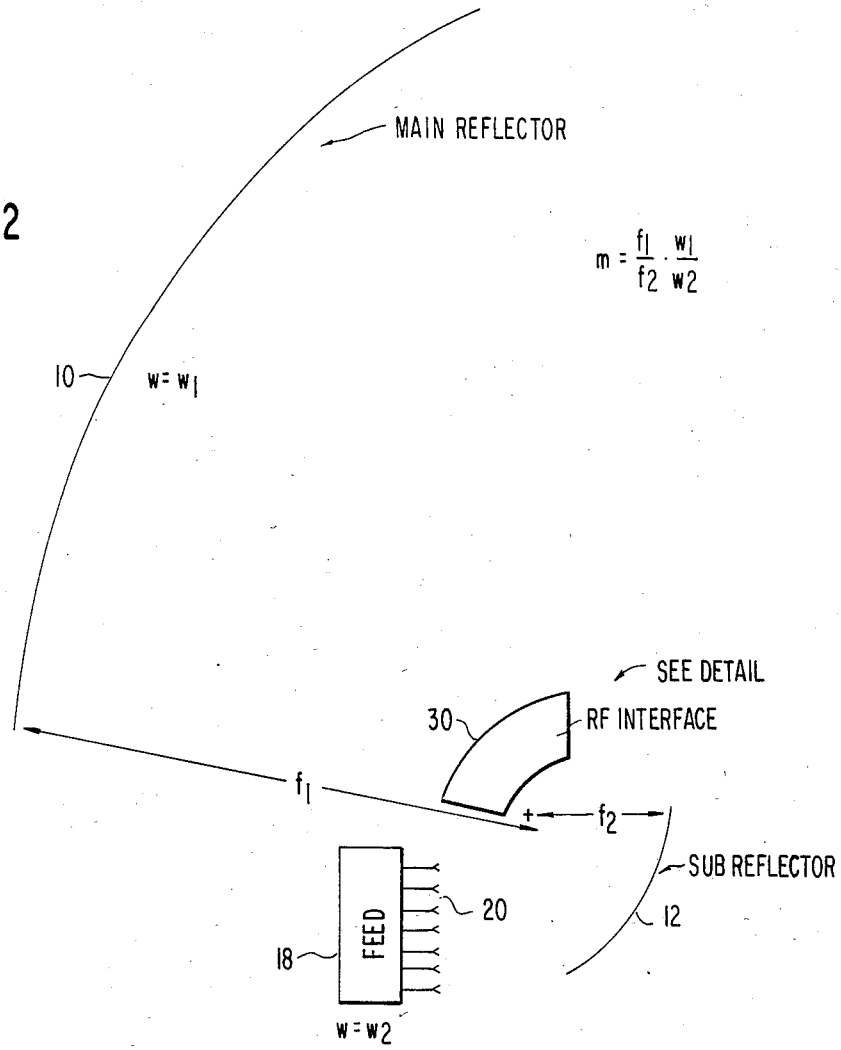
FIG. 2 is a brief schematic diagram of a Gregorian offset type antenna system according to the present invention.

An antenna system according to the present invention is illustrated in FIG. 2. It should be pointed out that, although the invention will be explained with reference to a Gregorian offset antenna system, the invention is applicable as well to Cassegrain antenna systems and is further applicable to symmetrical as well as offset configurations.

Figure 1:
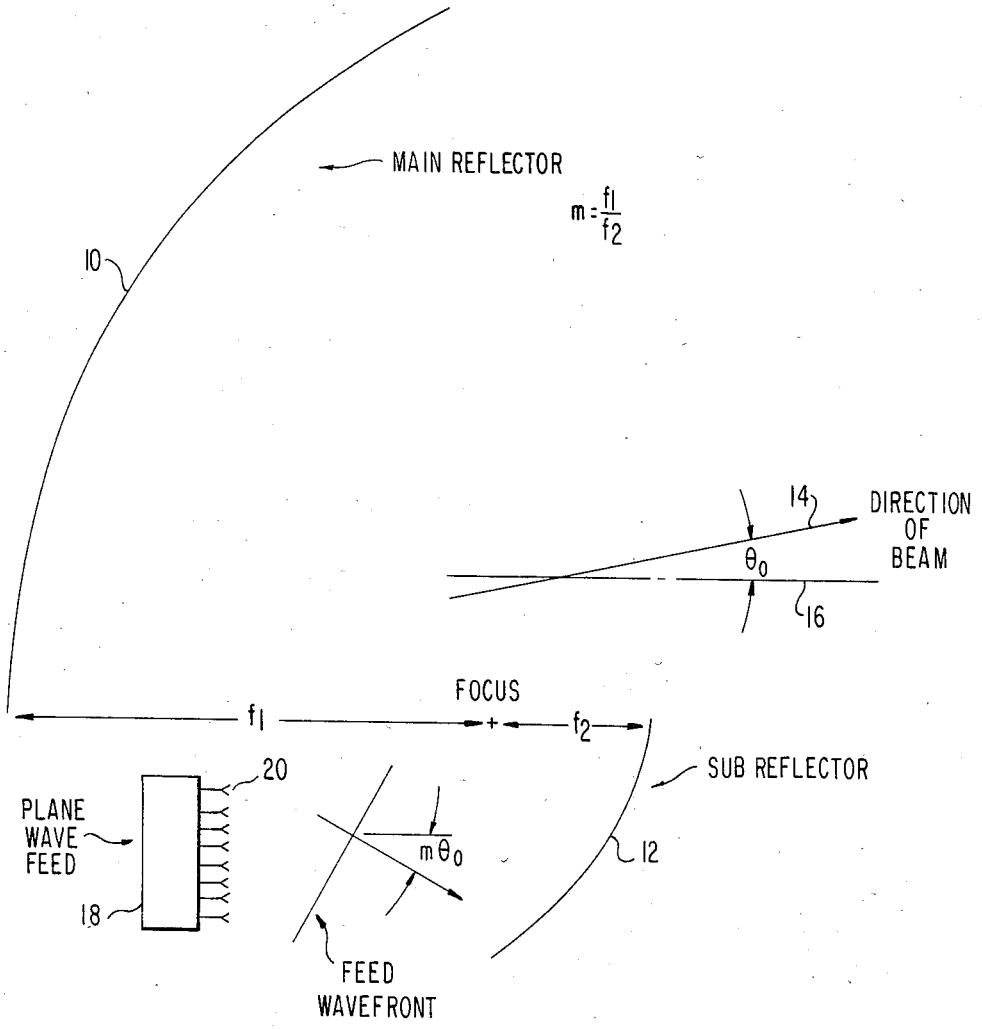
PRIOR ART FIG. 1
FIG. 1 is a brief schematic diagram for illustrating the operation of a Gregorian offset confocal paraboloidal antenna system.

As shown in FIG. 2, the antenna system according to the present invention uses a main reflector 10, subreflector 12 and plane wave feed 18 with a radiating array 20 similar to those employed in the conventional antenna arrangement of FIG. 1. The novel feature of the present invention resides in the provision of an RF interface unit 30 disposed between the subreflector and main reflector. The wave front emitted from the radiators 20 toward the subreflector has a frequency $\omega_2$ until it strikes the RF interface 30. The interface 30 then converts the frequency of the wave front to a different frequency $\omega_1$ and the frequency-converted wave front is then reflected from the main reflector 10 and radiated from the system. With the feed/subreflector system operating at a frequency $\omega_2$ and the main system operating at a frequency $\omega_1$, the magnification of the overall system is given by $m=(\omega_1/\omega_2)\cdot(f_1/f_2)$, where $\omega_1$ is the radiation frequency of the system, $f_1$ is the focal length of the main reflector, $\omega_2$ is the feed system frequency and $F_2$ is the focal length of the subreflector.

As can be seen from the above equation, the antenna designer can choose a set of system parameters such that the magnification is sufficiently low so that the scanning requirement of the feed as well as the uncorrected aberrations are acceptable, while at the same time the physical size of the feed system can be maintained small. For example, for a magnification factor of $m=1$, the conventional antenna system of FIG. 1 would not be required to steer its beam wave front by an excessive amount, and its uncorrected aberrations would be maintained at an acceptable level. However, such a magnification factor would be determined only by the focal lengths of the main and subreflectors, and would require that the main and subreflectors be of approximately the same size. With the antenna of FIG. 2, however, the magnification factor is not determined solely by the ratio of the focal lengths but is also affected by the ratio of the two operating frequencies. For example, choosing $f_1/f_2=\omega_2/\omega_1=6$, would result in a magnification factor of $m=1$ which would result in the same advantageous scanning requirements for the feed system and the same advantageous uncorrected aberration levels, but would also permit a main reflector to subreflector area ratio of 36:1.

The operation of the invention is based upon the well known principal of frequency scaling of optical and microwave optical devices. Stated simply, if a reflector system is reduced in size by a factor p and the frequency of operation is increased by the same factor p, then the performance of the system is unchanged. This equality of performance applies also to phase errors in an imperfectly focused system.

Figure 3:
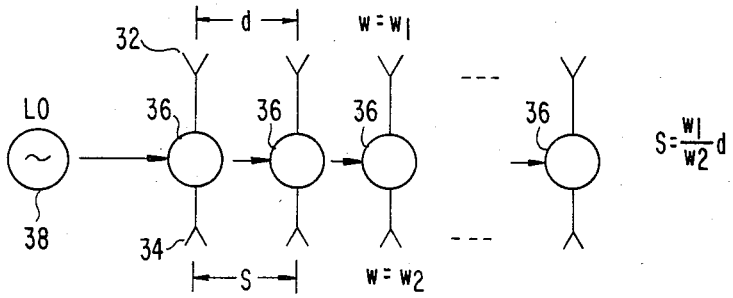
FIG. 3 is a brief diagram for explaining the arrangement of the feed system in FIG. 2.

The operation of the invention is also based upon the fact that signal phase is preserved through a frequency conversion. Thus, discrete fields in the focal region of the subreflector can be sampled, frequency converted and reradiated at the new frequency without causing phase problems. This can be accomplished by a simple interface arrangement such as shown in FIG. 3, whereby back-to-back arrays 32 and 34 of sampling elements such as horns, dipoles, etc., are separated by a set of mixers 36 driven from a common local oscillator 38. The receiving elements 34 receive the beam of frequency $\omega_2$ which is reflected from the subreflector 12, the beam is frequency converted in mixers 36, and the discrete sampled beams are then reradiated by radiating elements 32 at the new frequency $\omega_1$. The elements 32 are preferably equally spaced at intervals d, with the relationship between d and s being defined by $s=(\omega_1/\omega_2)\cdot d$. The number of sampling elements used and their spacing would be design features determined by the particular user and application and in accordance with well understood sampling theory to ensure that none of the signal information is lost during the conversion. It goes without saying that the system simply works in the reverse manner when receiving rather than radiating a beam.

The principle of operation of this invention can be extended to optical frequencies. For such a case, the sampling and frequency conversion could take place via an array of photodiodes. Phase detection using photodiodes presents some problems, but workable solutions have been demonstrated in the prior art as disclosed, for example, by J. S. Shreve, "The Optical Processor as an Array Antenna Controller", H.D. L.-TR-1905, November 1979. The operation of the system can, therefore, be extended to optical wavelengths with the only difference being the fact that the interface between the optics and the RF is more properly called an optoelectronic interface.

I claim:

1. A scanning or multiple beam confocal antenna, wherein said antenna comprises a feed for radiating a feed beam at a feed frequency $\omega_1$, a main reflector, and a subreflector for receiving said feed beam and reflecting it toward said main reflector, said main reflector radiating a beam at a radiation frequency $\omega_2$, said antenna further comprising frequency conversion means disposed between said main reflector and subreflector for receiving said feed beam reflected from said subreflector, frequency converting said feed beam and radiating toward said main reflector a radiation beam comprising said frequency-converted feed beam, said feed frequency $\omega_1$ and radiation frequency $\omega_2$ being different from one another, wherein said frequency conversion means comprises a plurality of first sampling elements for receiving or radiating said feed beam, a plurality of second sampling elements for receiving or radiating said radiation beam, a plurality of mixers coupling respective ones of said first and second sampling elements at a frequency conversion rate determined by a mixing signal, and a local oscillator for providing said mixing signal to each of said plurality of mixers.

2. An antenna as defined in claim 1, wherein said frequency conversion means also receives a radiation beam reflected from said main reflector at said radiation frequency, frequency converts said radiation and radiates toward said subreflector a feed beam having said feed frequency.

3. An antenna as defined in claim 1, wherein said first sampling elements are equally spaced at a distance s and said second sampling elements are equally spaced at a distance $d=s\cdot(\omega_2/\omega_1)$, where $\omega_1$ is said radiation frequency and $\omega_2$ is said feed frequency.

4. An antenna as defined in claim 1, wherein said feed comprises a steerable beam feed array and said antenna system comprises a multiple beam antenna system.

* * * * *